United States Patent [19]

Roed

[11] 4,073,714

[45] Feb. 14, 1978

[54] MEANS FOR COOLING OF SELF-BAKING ANODES IN ALUMINUM ELECTROLYSIS CELLS

[75] Inventor: Finn Roed, Havik, Norway

[73] Assignee: Norsk Hydro a.s, Oslo, Norway

[21] Appl. No.: 675,567

[22] Filed: Apr. 9, 1976

[30] Foreign Application Priority Data

Apr. 10, 1975 Norway ..... 751257

[51] Int. Cl.[2] ..... C25C 3/06; C25C 3/16; C25C 7/00

[52] U.S. Cl. ..... 204/243 R; 204/274; 204/289

[58] Field of Search ..... 204/243 R–247, 204/67, 280, 289, 274

[56] References Cited

U.S. PATENT DOCUMENTS 3,637,468 1/1972 Icxi et al. ..... 204/274

FOREIGN PATENT DOCUMENTS

| | | | |
|---|---|---|---|
| 4,224,730 | 7/1964 | Japan | 204/243 R |
| 203,921 | 7/1969 | U.S.S.R. | 204/243 R |
| 268,663 | 8/1970 | U.S.S.R. | 204/67 |
| 268,664 | 8/1970 | U.S.S.R. | 204/243 R |
| 278,124 | 11/1970 | U.S.S.R. | 204/243 R |

*Primary Examiner*—John H. Mack
*Assistant Examiner*—D. R. Valentine
*Attorney, Agent, or Firm*—Wenderoth, Lind & Ponack

[57] ABSTRACT

A cooling device for self-baking anodes in electrolytic cells for the production of aluminum includes plural cooling rods extending through openings in a supporting bar and supported thereby in a row covering a band-shaped zone along the center line of the cell anode. Each cooling rod is partly submerged in the anode mix of the cell and has a collar which determines the extent of such submergence. Each cooling rod is an aluminum extrusion having longitudinal ribs radiating from a center section.

14 Claims, 5 Drawing Figures

MEANS FOR COOLING OF SELF-BAKING ANODES IN ALUMINUM ELECTROLYSIS CELLS

BACKGROUND OF THE INVENTION

This invention relates to the cooling of self-baking anodes in Hall-Heroult electrolytic cells for the production of aluminum. These self-baking anodes, or Soderberg electrodes as they are called, consist of a steel mantle which is open at both ends and which is filled with a mixture normally consisting of petroleum coke and pitch. As the anode mix is consumed during electrolysis more mix is added from above. The heat developed is used to bake the anode mix as it descends in the mantle. In the upper part of the mantle there is a layer of hot, liquid mix which gives off large quantities of noxious volatile hydrocarbons, especially when the current-carrying anode bolts are withdrawn. Efficient cooling of the upper layer of the liquid mix permits control of the coking process in the self-baking anode. This results in a thicker and cooler layer of mix at the top of the anode. At the same time the tendency of the pitch and coke to segregate is reduced so that the anode mix becomes more homogeneous. Evaporation of the hydrocarbons is thus reduced, resulting at the same time in improved quality of the anode. The use of cooling air, submerged cooling coils and partly submerged, vertical cooling rods, where the non-submerged part of the rods is air-cooled by natural convection, have already been proposed for the cooling of the surface of anodes. However, prior known devices of the latter type are hardly practical in use. It has been considered essential to place the cooling rods in the vicinity of the current-carryihg bolts and, as far as possible, in such a way that they cover the entire surface of the anode. However, the cooling device can easily obstruct the bolts and the bolt-removing equipment, and it has been necessary to make it solid and strong enough to withstand the impact and compressive stresses which occur. The individual cooling rods are usually permanently fixed in transverse beams mounted above the anode mantle, and the equipment has taken up so much space and been so dominating that operations and maintenance of the cells have been hampered.

SUMMARY OF THE INVENTION

According to the invention a new and improved type of cooling device has been provided which does not have the aforementioned drawbacks, and which does not hamper the withdrawal of bolts. The design is characterized by its simplicity. It is simple to install, the cooling rods are self-adjusting and can be removed for cleaning and be replaced without resorting to complicated equipment and lifting devices. As already mentioned, in the case of prior known rod-type cooling devices, primary importance has been placed on even cooling of the anode surface. However with the device according to the invention cooling is concentrated to a band-shaped zone which runs along the entire length of the anode, and there is relatively little extension in the transverse direction. The resultant cooling does not restrict itself to a limited area around each cooling rod, as no doubt persons skilled in the art would expect, but has its effect over the entire surface of the anode. Thus the cooling device can be mounted along the centre line of the anode, and at the greatest possible distance from the row of anode bolts on each side, thereby radically lowering the baking zone along the centre line of the anode, as well as lowering it to a certain extent in the area of the anode bolts. A symmetrical baking zone ridge is thus achieved on both sides of the centre line of the anode. The effect will thus be a deeper, cooler and more homogeneous liquid anode mix which efficiently reduces the amount of pitch gas from the anode, and which rapidly fills holes left by bolts with a homogeneous mix which is baked to a less porous anode under newly positioned bolts, thus reducing the danger of explosion when withdrawing bolts. The symmetrical baking zone ridge will also maintain the electrical contact between the bolts and the anode, since it is normally the baked part of the anode which becomes conducting.

The device according to the invention is specially characterized in that each cooling rod is arranged in a band-shaped zone along the centre line of the anode, and is held in position by a longitudinal aluminum bar equipped with a steering or supporting mechanism for each cooling rod.

The device is further characterized in that each cooling rod is self-adjusting, it moving freely in the steering mechanism but being equipped with a collar or the like, which determines the maximum submergence of the rod. It is essential that all parts of the cooling system be constructed of aluminum since magnetic metal such as steel will hamper the insertion of the anode bolts.

BRIEF DESCRIPTION OF THE DRAWINGS

The invention will now be described in more detail with reference to the attached drawings, which show a preferred embodiment of the cooling device, which in practical tests has been proven to give satisfactory results.

DETAILED DESCRIPTION OF THE INVENTION

Figure 1:
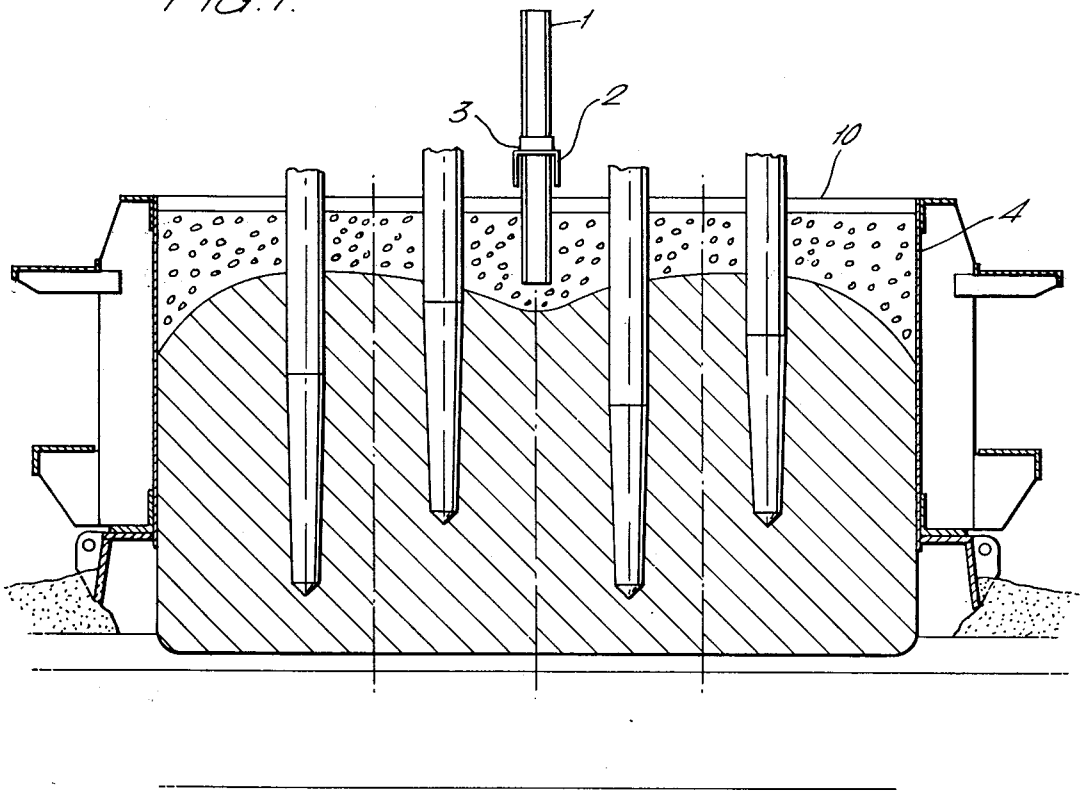
FIG. 1 is a cross-section of a Soderberg electrode with the cooling device in the mounted position.
Figure 2:
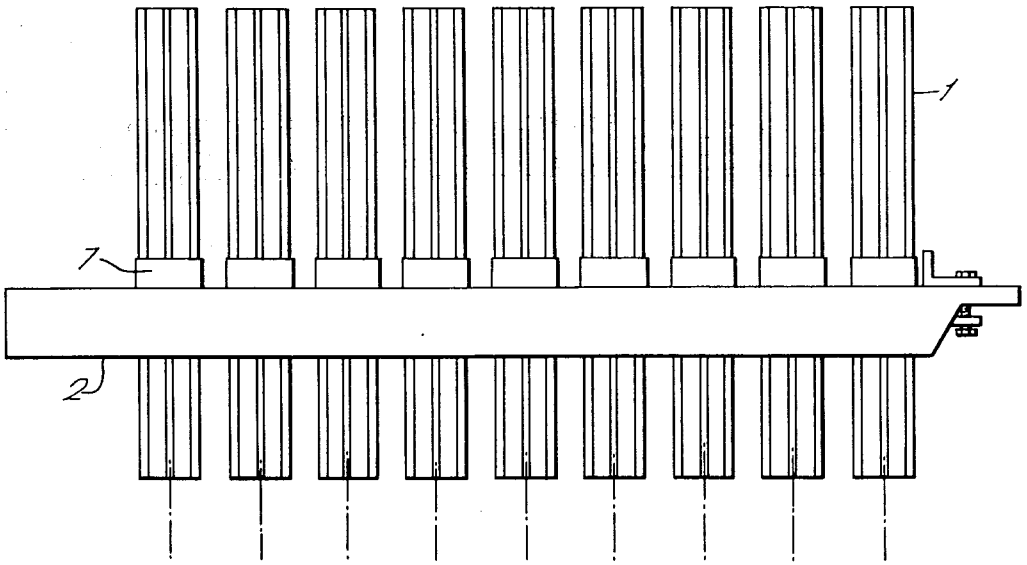
FIG. 2 is a side view of the cooling device.
Figure 3:
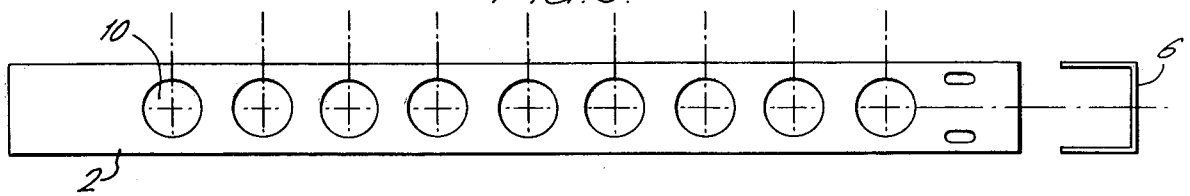
FIG. 3 is a plan view of the supporting bar.
Figure 4:
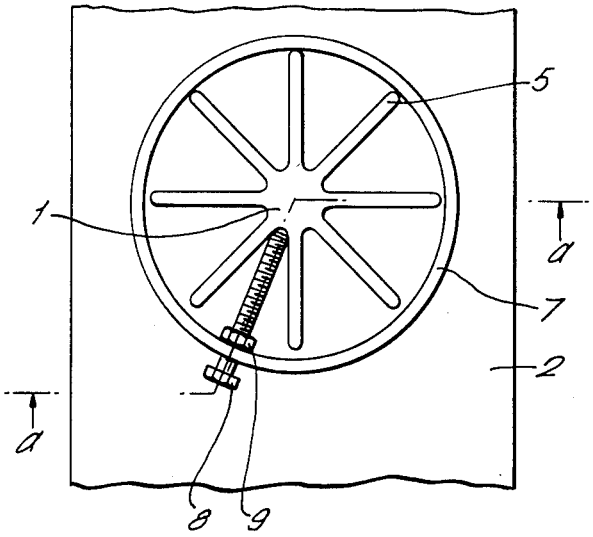
FIG. 4 is a plan view of the device.
Figure 5:
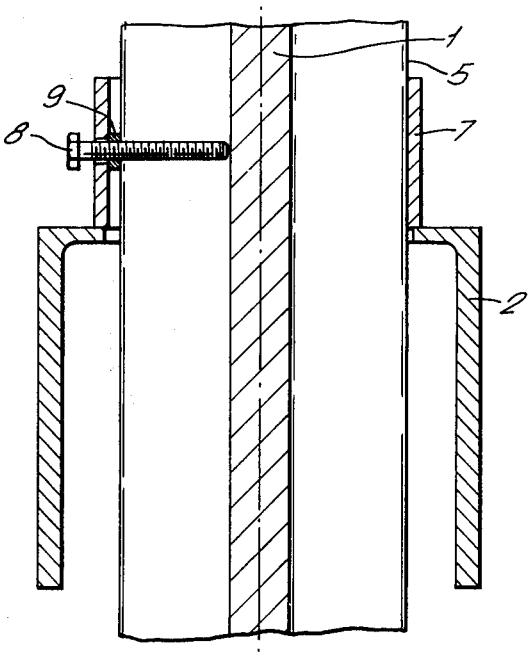
FIG. 5 is a vertical section taken along line a—a of FIG. 4.

FIG. 1 shows the cooling rods 1 which pass through holes 10 in a supporting bar 2 which is clamped to a transverse box bar 3, which forms part of the anode mantle 4. The cooling rods are submerged about 30 cm in the mix at the top of the anode. The heat from the mix is transferred to the rods and is transported upwardly. The rods will thus be air-cooled by natural convection. The rods are rib-shaped extrusions with ribs or blades 5 radiating from a centre core. The rods are preferably of pure aluminum of high conductivity and can be produced by hot extrusion. The supporting bar 2 is also of aluminum and is channel-shaped, the web 6 of the channel having therein circular recesses 10 large enough in diameter to allow the cooling rods to pass therethrough. Each individual cooling rod is fitted with a stopper in the form of a collar 7 which, by means of a screw 8 extending therethrough and nuts 9, can be fixed on the cooling rod in any position whatsoever. The cooling rods lie freely in the holes 10 of the channel-shaped aluminum bar and can be removed and replaced individually. This simple, easily handled arrangement, which is the result of design as well as choice of extrusions and materials, provides a very flexible and useful cooling device. The aluminum bar 2 can be lowered into position between the conductor rails above the anodes while the cells are in operation and be fixed to the box bars by means of an elongated pipe key. The cooling rods 1 can then be lowered down into the holes 10 in the aluminum bar 2 by means of tongs, etc. In reverse order the rods can be taken out individually during operation and be cleaned and replaced, or an entire set of rods can be replaced by new rods in very little time and without the aid of special lifting equipment.

EXAMPLE

The cooling device has been tested on two 130 KA Soderberg cells under normal operational conditions, the temperature being measured at three points on the surface of the anode at 3-day intervals. At the same time the temperature was also measured at three points on two similar Soderberg cells not equipped with the cooling device. The results are shown below:

Table 1:

| | | Anode Temperatures |
|---|---|---|
| | 1 | 198° 200° 219° |
| Test cell | 2 | 209° 204° 205° |
| No. 1 | 3 | 178° 180° 179° |
| (cooled) | 4 | 177° 184° 163° |
| | | B.32 |
| | 1 | 250° 230° 226° |
| Test cell | 2 | 191° 193° 192° |
| No. 2 | 3 | 177° 167° 177° |
| (cooled) | 4 | 177° 184° 163° |
| | | B.105 |
| | 1 | 192° 191° 215° |
| Reference cell | 2 | 215° 206° 192° |
| No. 1 | 3 | 232° 220° 250° |
| (not cooled) | 4 | 244° 234° 241° |
| | | B.106 |
| | 1 | 195° 192° 200° |
| Reference cell | 2 | 221° 220° 202° |
| No. 2 | 3 | 217° 233° 255° |
| (not cooled) | 4 | 229° 220° 228° |

As will be seen from these results, an effective cooling of the anode surface temperature of from 50° – 60° C was achieved. This resulted in a considerable reduction of gases from pitch, etc. The reduction was so great that it could be observed visually. While considerable amounts of gas could be seen to be discharged from the uncooled anodes, the cooled anodes were virtually gas-free.

I claim:

1. A device for cooling a self-baking anode in an electrolysis cell for the producing of aluminum, such anode being of the type including a mantle open at the top and bottom thereof and filled with anode mix, and having first and second groups of anode bolts extending into opposite sides of said anode mix, said device comprising:

a plurality of solid and unperforated, vertically positioned, longitudinal cooling rods; and means for supporting said cooling rods peripherally thereof in a row extending only along a narrow band-shaped zone encompassing the longitudinal center line of the anode between the groups of anode bolts, such that a lower portion of each said cooling rod may be submerged in the anode mix and an upper portion of each said cooling rod may extend above the anode mix.

2. A cooling device as claimed in claim 1, wherein said supporting means comprises a longitudinal supporting bar adapted to be fixedly mounted with respect to the mantle of the anode, each of said cooling rods being peripherally supported by said supporting bar.

3. A cooling device as claimed in claim 2, wherein each said cooling rod is self-adjusting and capable of gliding into said supporting bar, each said cooling rod having fitted thereto a stopper in the form of a collar to determine the depth of submergence of said cooling rod.

4. A cooling device as claimed in claim 3, further comprising plural circular openings in said supporting bar, said cooling rods extending through said circular openings.

5. A cooling device as claimed in claim 3, wherein each said cooling rod has blade-shaped ribs radiating from a center section thereof, said ribs extending in the longitudinal direction of said rod.

6. A cooling device as claimed in claim 3, wherein said cooling rods comprise aluminum extrusions.

7. A cooling device as claimed in claim 3, wherein all parts of the cooling system are of aluminum.

8. In a self-baking anode for an electrolysis cell for the production of aluminum, said anode having a mantle which is open at the top and bottom thereof and filled with anode mix, said first and second groups of anode bolts extending into opposite sides of said anode mix, the improvement comprising a device for cooling said anode and including:

a plurality of solid and unperforated, vertically positioned, longitudinal cooling rods extending only along a narrow band-shaped zone encompassing the longitudinal center line of said anode between said groups of anode bolts, each said cooling rod having a lower portion submerged in said anode mix and an upper portion extending above said anode mix; and means for supporting said cooling rods peripherally thereof in a row extending along said band.

9. The improvement claimed in claim 8, wherein said supporting means comprises a longitudinal supporting bar fixedly mounted with respect to said mantle, each of said cooling rods being peripherally supported by said supporting bar.

10. The improvement claimed in claim 9, wherein each said cooling rod is self-adjusting and capable of gliding into said supporting bar, each said cooling rod having fitted thereto a stopper in the form of a collar to determine the depth of submergence of said cooling rod.

11. The improvement claimed in claim 10, further comprising plural circular openings in said supporting bar, said cooling rods extending through said circular openings.

12. The improvement claimed in claim 19, wherein each said cooling rods has blade-shaped ribs radiating from a center section thereof, said ribs extending in the longitudinal direction of said rod.

13. The improvement claimed in claim 10, wherein said cooling rods comprise aluminum extrusions.

14. The improvement claimed in claim 10, wherein all parts of the cooling system are aluminum.

* * * * *